US005628639A

United States Patent [19]

Eichholz, Jr. et al.

[11] Patent Number: 5,628,639

[45] Date of Patent: May 13, 1997

[54] ELECTRICAL CONNECTOR WITH DIFFERENT LEAD ARRANGEMENTS AT ITS OPPOSITE ENDS

[75] Inventors: Kenneth L. Eichholz, Jr.; Mark F. Johnston; William D. Lanyi; Bradley T. Woods, all of Freeport, Ill.

[73] Assignee: Honeywell Inc., Minneapolis, Minn.

[21] Appl. No.: 544,220

[22] Filed: Oct. 17, 1995

[51] Int. Cl.[6] ..... H01R 9/09

[52] U.S. Cl. ..... 439/79; 439/736; 439/885

[58] Field of Search ..... 439/79, 80, 709, 439/494, 736, 55, 76.1, 78, 883–885

[56] References Cited

U.S. PATENT DOCUMENTS 5,192,228 3/1993 Collins et al. ..... 439/607 X 5,267,875 12/1993 Koegel et al. ..... 439/607 X

*Primary Examiner*—Khiem Nguyen

*Attorney, Agent, or Firm*—William D. Lanyi

[57] ABSTRACT

A connector is made by cutting a continuous strip of conductive material to provide individual fingers that extend in a direction perpendicular to the length of the strip. The fingers are individually bent to offset their distal ends from their connective ends. The process defines bend lines on each of the fingers and then bends the fingers to offset their distal ends from their respective connective ends in directions perpendicular to the plane of the conductive strip and along its length. After appropriately bending each of the fingers, a nonconductive material is molded around the group of fingers. Following the molding operation, the connective ends of the fingers are severed from the uncut portion of the strip to singular an electrical connector from the continuous strip of connectors.

16 Claims, 7 Drawing Sheets

Fig. 1
(PRIOR ART)
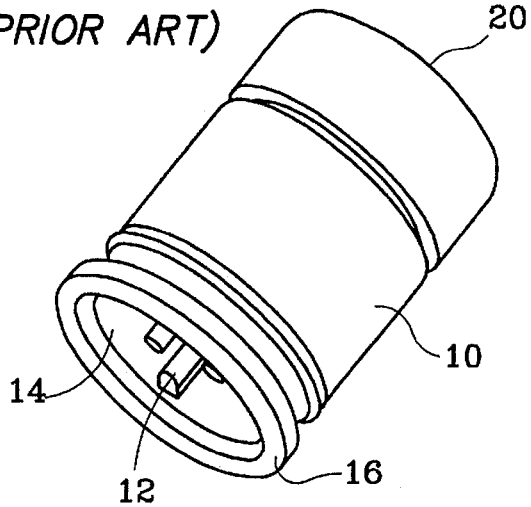
Fig. 2
(PRIOR ART)
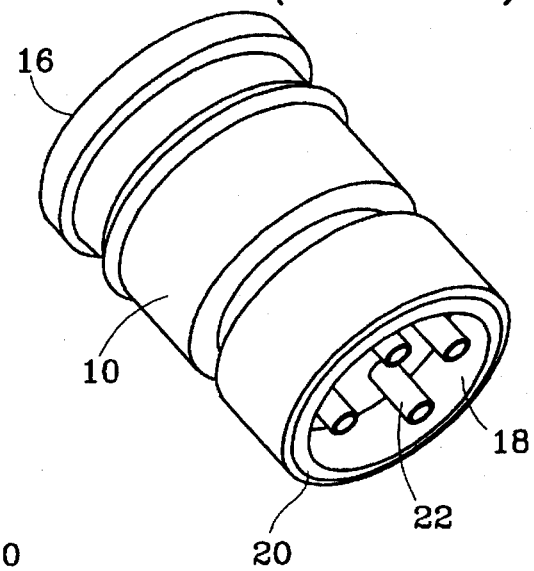
Fig. 3
(PRIOR ART)
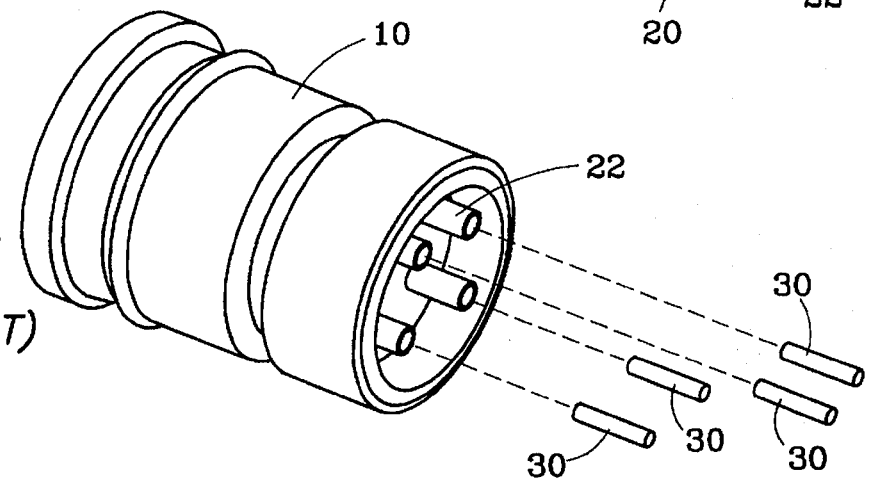
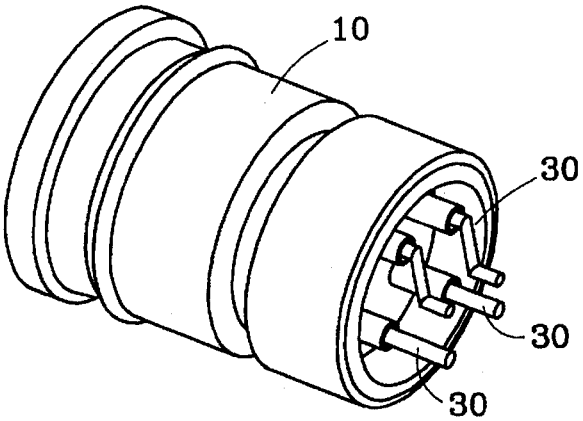
Fig. 4
(PRIOR ART)

ELECTRICAL CONNECTOR WITH DIFFERENT LEAD ARRANGEMENTS AT ITS OPPOSITE ENDS

BACKGROUND OF THE INVENTION

1. Field of the Invention

The present invention is generally related to a method for manufacturing an electrical connector and, more particularly, to a method for manufacturing an electrical connector that has a first pattern of leads extending from the connector in a first direction and a second pattern of leads extending from the connector in another direction.

2. Description of the Prior Art

Many different types of electrical connectors are known to those skilled in the art. Certain types of connectors are intended for use in providing electrical communication between a first component on one side of a nonconductive barrier and a second component on an opposite side of the nonconductive barrier. For example, certain proximity detectors and photoelectric detectors are provided with a four-pin connector to facilitate the detector being connected to an electrical cable.

Most known connectors utilize a plurality of pins that are inserted into a nonconductive element or, alternatively, a plurality of pins around which a nonconductive material is molded. The manufacture of connectors of this type, regardless of the number of pins used, requires that the individual pins be held in place so that the nonconductive material can be molded around them. This procedure can be very complicated and can significantly increase the costs of the connector. In addition, the connection of the electrical connector to an electronic component, such as a proximity sensor or photoelectric sensor, also requires that the pins be connected in electrical communication with components of a circuit board within the electronic component. This connecting procedure can be complicated and costly if both ends of the pins are arranged in an identical pattern.

It would therefore be significantly beneficial if an electrical connector could be formed in which the pins extending from one end of the connector are arranged in a first preselected pattern while the pins extending from the opposite end of the connector are arranged in a second preselected pattern to facilitate their assembly and connection in electrical communication with components within the detector to which the connector is attached.

SUMMARY OF THE INVENTION

The present invention provides an electrical connector that has electrically conductive pins extending from one end of the connector in a first preselected pattern and also extending from the opposite end of the electrical connector in a second preselected pattern. This allows the connector to be attached to a printed circuit board, or similar element, within an electrical apparatus in such a way that the manufacturing steps required to manufacture and connect the electrical connector to the apparatus are simplified and made less expensive.

The method for making the electrical connector of the present invention comprises a step of providing a strip of electrically conductive material having a length and a width. The strip of electrically conductive material has a plurality of electrically conductive fingers extending in a direction generally perpendicular to the length of the strip. Each of the fingers has a connective end attached to the strip and a distal end extending away from the strip. Another step of the present invention is defining first and second bend lines on a preselected one of the plurality of electrically conductive fingers. Although it should be understood that each of the plurality of electrically conductive fingers can be provided with the defined first and second bend lines, certain applications of the present invention may require the bending on only a single electrically conductive finger.

The present invention also comprises the step of bending the preselected electrically conductive finger at each of the first and second bend lines to dispose the distal end of the preselected electrically conductive finger at a location which is offset from its connective end in a direction generally perpendicular to the plane of the strip. The present invention further comprises the step of molding the plurality of electrically conductive fingers within an electrically nonconductive material, such as plastic, with the distal ends protruding from the nonconductive material in a first direction and the connective ends protruding from the nonconductive material in a second direction. The present invention also comprises the step of severing the connective ends from the strip of electrically conductive material.

In a particularly preferred embodiment of the present invention, each of the distal ends of the fingers is formed into a generally cylindrical cross sectional shape to facilitate its eventual combination with a cable connector. In addition, each of the distal ends of the fingers can be disposed at a different corner of a quadrangular pattern.

In a preferred embodiment of the present invention, a strip of conductive material is provided which has a length that far exceeds its width. In other words, for automatic manufacturing and assembly techniques, the strip of electrically conductive material can be one or two inches wide, but several hundred feet long. This permits automatic feeding from a continuous roll of material and allows all of the processes to be performed sequentially by automatic machines. In this type of arrangement, the first step of the present invention is the providing of a generally flat strip of an electrically conductive material that has a length and a width. The strip has a first axis extending along the length and a second axis extending along the width. The first and second axes are both disposed within the plane of the strip and are generally perpendicular to each other. The present invention also comprises the step of forming a plurality of generally parallel cuts in the strip of electrically conductive material, wherein each of the cuts extends partially through the width of the strip in a direction generally parallel to the second axis to result in cut and uncut portions of the strip. The plurality of cuts define a plurality of electrically conductive fingers between the cuts that extend perpendicularly to the first axis of the strip. Each of the plurality of electrically conductive fingers has a connective end attached to the uncut portion of the strip and a distal end extending away from the uncut portion of the strip. The present invention also comprises the step of defining first and second bend lines on each of the plurality of electrically conductive fingers. The first and second bend lines can be arranged in nonparallel relation to the first axis of the strip. In addition, the present invention comprises the step of bending each of the plurality of electrically conductive fingers at each of the first and second bend lines in order to displace the distal ends of each electrically conductive finger away from the connective end of the same electrically conductive finger in a direction parallel to the first axis and in a direction perpendicular to the plane of the strip. In a particularly preferred embodiment of the present invention, it also comprises the step of forming each of the distal ends of the fingers into a generally cylindrical cross sectional shape. In addition, the present invention further comprises the step of molding an electrically nonconductive material, such as plastic, over the plurality of electrically conductive fingers with the distal ends protruding from the nonconductive material in a first direction and the connective ends protruding from the nonconductive material in a generally opposite direction. Following the molding step, the present invention further comprises the step of severing the connective ends from the uncut portion of the strip. Although the fingers can be bent to achieve virtually any desired pattern of the distal ends, one particular pattern that can be achieved through the steps of the present invention is one in which the distal ends are arranged in a quadrangular pattern with each of the distal ends being disposed in a different corner of the quadrangular pattern. Although the length of the strip from which the electrical connectors are made can vary significantly from application to application, certain significant economic advantages can be achieved when the length exceeds the width by a significant ratio. It is anticipated that in most applications of the present invention, the length of the electrically conductive strip will exceed its width by at least four times.

BRIEF DESCRIPTION OF THE DRAWINGS

The present invention will be more fully and clearly understood from a reading of the Description of the Preferred Embodiment in conjunction with the drawings, in which:

FIGS. 1 and 2 show opposite perspective views of an electrical connector known to those skilled in the art;

FIGS. 3 and 4 show successive steps in connecting the known electrical connector to an electrical apparatus;

DESCRIPTION OF THE PREFERRED EMBODIMENT

Figure 5:
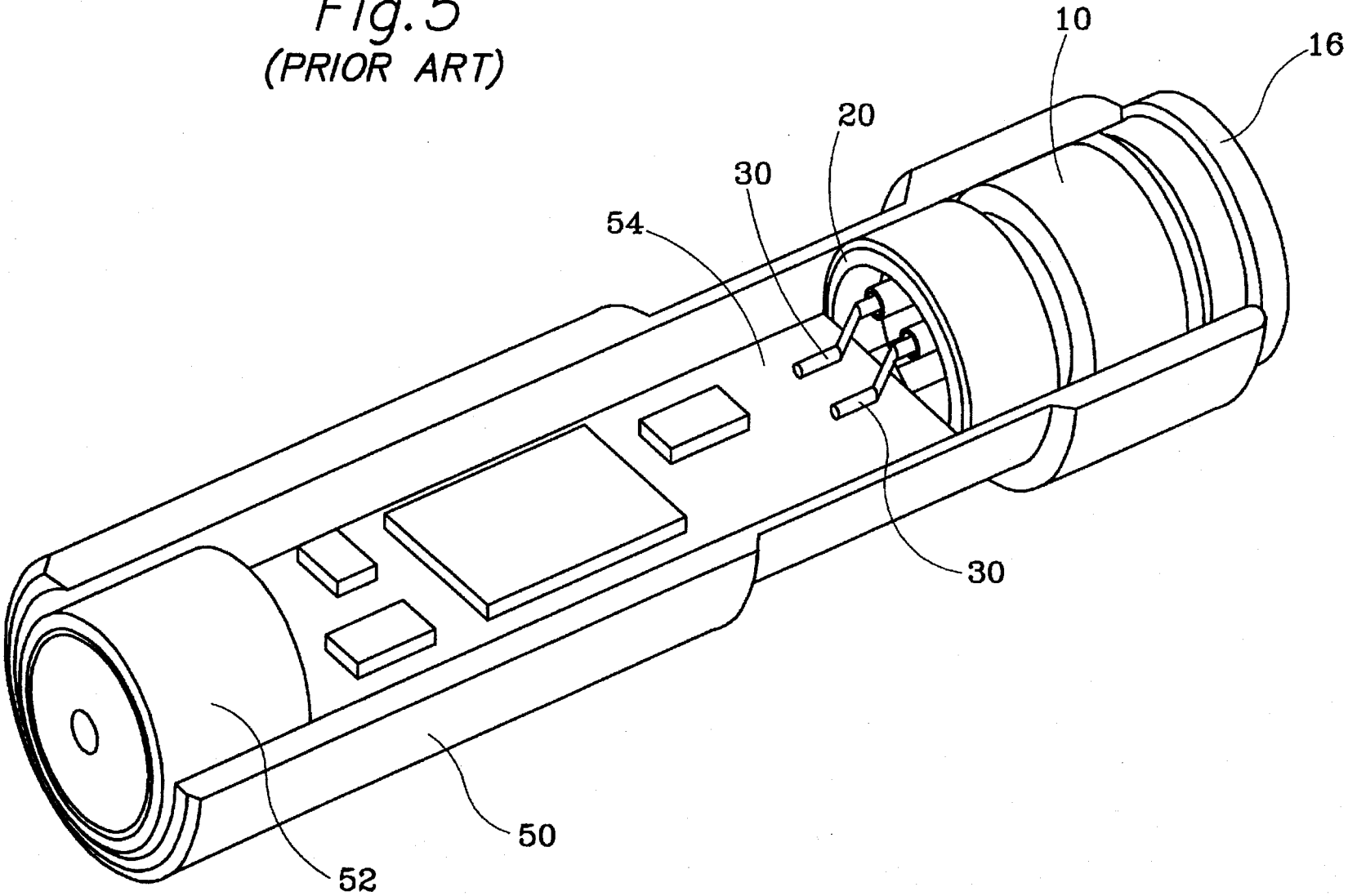
Fig. 5 (PRIOR ART)
FIG. 5 shows an electrical connector known to those skilled in the art attached to a proximity sensor.

Throughout the Description of the Preferred Embodiment of the present invention, like components will be identified by like reference numerals.

FIGS. 1 and 2 show two views of an electrical connector that is well known to those skilled in the art. In FIG. 1, a nonconductive material 10 is molded around four straight conductive pins which are not all viable in FIG. 1. One end of each of the pins extends from the nonconductive material 10 in a first direction. These ends 12 are disposed within a first cavity 14 of the nonconductive material 10 so that the pins are protected from potential damage. The cavity 14 is located at one end 16 of the connector.

FIG. 2 shows the opposite end 20 of the connector described above in conjunction with FIG. 1. The opposite end 22 of each of the pins described above extends into a cavity 18 at the other end 20 of the connector. These ends 22 of the pins are formed into hollow solder cups to facilitate the electrical connection between the connector and external pins or wires used in conjunction with an electrical component to which the connector is to be attached.

With continued reference to FIGS. 1 and 2, it should be understood that the connector shown in the Figures is manufactured by first providing four pins that are particularly shaped to suit the application. In other words, one end of each of the pins is shaped as indicated by reference numeral 12 in FIG. 1 and the other end of each pin is shaped as indicated by reference numeral 22 in FIG. 2. This shaping of the individual pins can be performed on a miniature lathe, but other manufacturing procedures could also be used. After the pins are shaped to suit the application, they are positioned relative to each other in a parallel arrangement to define a specific pattern. Although a typical pattern could place the ends 12 at the corners of a square pattern, it should clearly be understood that many other patterns are possible. With the pins held firmly in place to define the pattern of the ends 12, a nonconductive material is molded around the four pins to retain them in position and provide a means for allowing the four pins to be connected to an electrical apparatus. An alternative method of manufacturing could provide a nonconductive component with four holes formed through it and then inset each of the four pins into the holes. Either way, it should be understood that each of the pins extends in a straight line between one end 12 and the opposite end 22.

FIGS. 3 and 4 show how the connector described above is attached to an electrical device. First, as illustrated in FIG. 3, a plurality of soldering pins 30 are inserted into the soldering cups at the ends 22 and then soldered into position. Then, as shown in FIG. 4, the pins are selectively bent to place their ends at beneficial locations relative to some component within the electrical device to which the connector is to be attached. This bending of the soldering pins 30 facilitates the eventual electrical connection between the connector and the associated electrical device.

FIG. 5 shows the connector attached to an electrical device. In the example illustrated in FIG. 5, the electrical device is a proximity detector that has a housing 50, a core element 52 at one end of the housing 50 and a printed circuit board 54 contained within the housing. The connector is attached to one end of the housing 50 with the soldering pins 30 extending into the cavity provided by the housing 50. In order to provide electrical connection between the connector and the printed circuit board 54, the soldering pins 30 are soldered to conductive runs on the printed circuit board 54. Although these conductive runs are not illustrated specifically in FIG. 5, the provision of electrically conductive runs on printed circuit boards is well known to those skilled in the art as are the many different types of electrical connections that can be made between the soldering pins 30 and the conductive runs of a typical printed circuit board. The shape of the soldering pins 30, as described above in conjunction with FIG. 4, facilitates the connection of two soldering pins to the top side of the printed circuit board 54 while the other two soldering pins 30 are electrically connected to conductive runs on the bottom side of the printed circuit board 54.

With the items connected together as shown in FIG. 5, the electrical connector is then permanently attached to one end of the housing 50 to provide a water tight connection that prevents the internal components of the sensor from being damaged. Although not shown in the view of the FIG. 5, it should be understood that the ends 12 of the pins shown in FIG. 1 extend out of the nonconductive material 10 and into the cavity 14 at the first end 16 of the connector.

Figure 6:
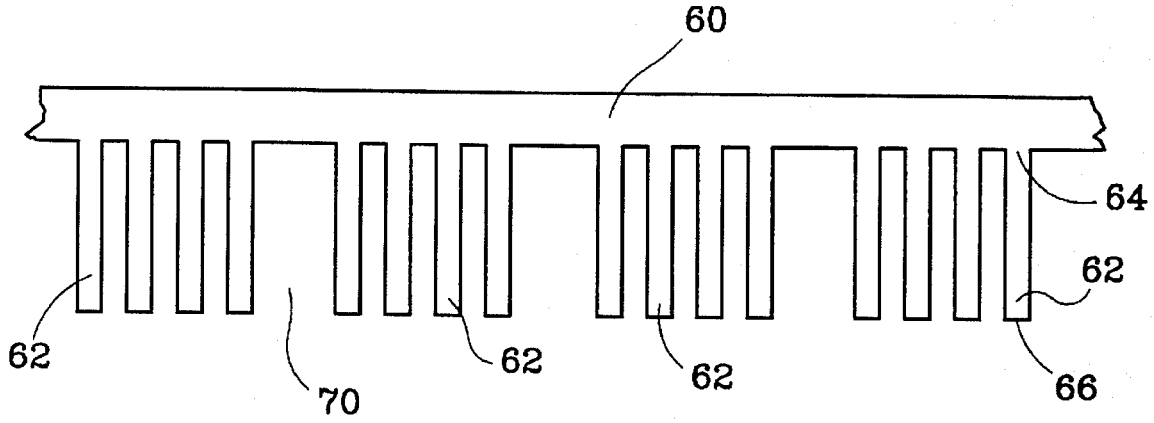
FIG. 6 shows a conductive strip cut to provide a plurality of fingers in accordance with the present invention.

A connector made in accordance with the principles of the present invention is made by first providing an electrically conductive strip of material as shown in FIG. 6. The strip 60 has a plurality of electrically conductive fingers 62 extending in a direction that is generally perpendicular to the length of the strip 60. Each of the conductive fingers has a connective end 64 and a distal end 66. The connective end 64 is attached to the strip 60 while the distal end 66 extends away from the strip. As shown in FIG. 6, the fingers 62 can be grouped in arrangements of four fingers per group with a slightly extended gap 70 between the groups. However, it should be clearly understood that the extended gap 70 is not a requirement in all applications. When used, the extended gap 70 provides additional space between the regions between where connectors are later to be formed by molding nonconductive material around the groups of four fingers.

Figure 7:
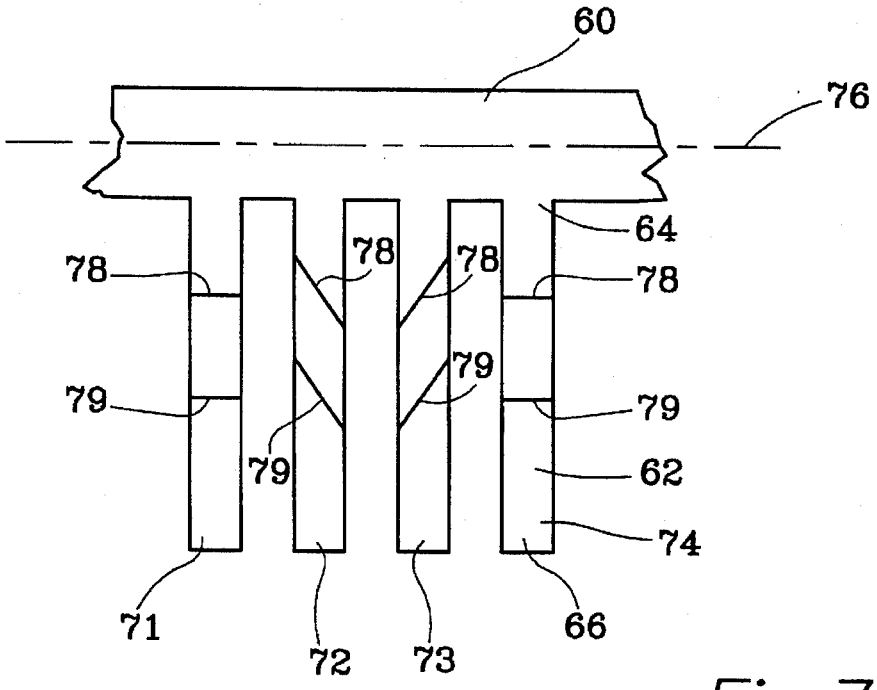
FIG. 7 shows one group of fingers of the strip illustrated in FIG. 6.

FIG. 7 shows one group of fingers 62 attached to the electrically conductive strip 60. In FIG. 7, each of the fingers 62 is provided with first and second bend lines defined on a preselected surface of the fingers. Although it should be clearly understood that actual visible bend lines need not be marked on each finger, the lines shown in FIG. 7 illustrate the locations at which the fingers will later be bent to achieve one of the advantages of the present invention. The four fingers in FIG. 7 are identified by reference numerals 71–74. The central fingers, 72 and 73, are marked with first and second bend lines that are arranged in nonparallel association with an axis 76 that extends along the length of the strip 60. As shown in FIG. 7, each of the first bend lines 78 defines a line along which the respective finger will be bent. Second bend lines 79 are also defined on each of the fingers. It should be noted that bend lines 78 and 79 on fingers 72 and 73 are arranged at a significantly greater angle, relative to the axis 76, than the first and second bend lines on the outer fingers 71 and 74. The difference in the angles of the bend lines results from the intended shape to which the fingers are to be bent in order to achieve the desired pattern of the distal ends 66 relative to the connective ends 64. If, as shown by bend lines 78 and 79 of the outer fingers 71 and 74, the bend lines are generally parallel to the axis 76 or only slightly nonparallel to this axis, the distal end 66 of the associated finger will not be disposed at a location that is significantly offset from the associated connective end 64 in a direction along the axis 76. If, on the other hand, the angles of the bend lines are at a significant angle to the axis 76, as shown on the central fingers 72 and 73, the distal ends 66 of the fingers will be significantly offset from their respective connective end 64 as a result of the double bend provided by the first and second bend lines, 78 and 79. This phenomenon will be described in greater detail below. Throughout the following description of the bend lines and fingers, a single group of four fingers will be illustrated and described. The selection of a group of four fingers results from the fact that a typical connector design incorporates four pins. However, it should be clearly understood that alternative designs of electrical connectors could easily result in a number of fingers that is different than four.

Throughout the Description of the Preferred Embodiment, the present invention is described as comprising a conductive strip 60 with a plurality of fingers 62 extending from the conductive strip in a direction generally perpendicular to the axis of the length of the strip. However, it should be understood that most typical manufacturing procedures would actually begin with a conductive strip having a length and a width, but no fingers extending therefrom. Then, as part of the manufacturing process, appropriate dies and punching elements would be used to create cuts that are perpendicular to the axis 76 of the strip of the strip 60. These cuts would provide the notches that separate and define the electrically conductive fingers 62. The cuts would create the fingers and leave the remaining uncut portion of the strip to which the connective ends 64 of the fingers are attached.

Figure 8:
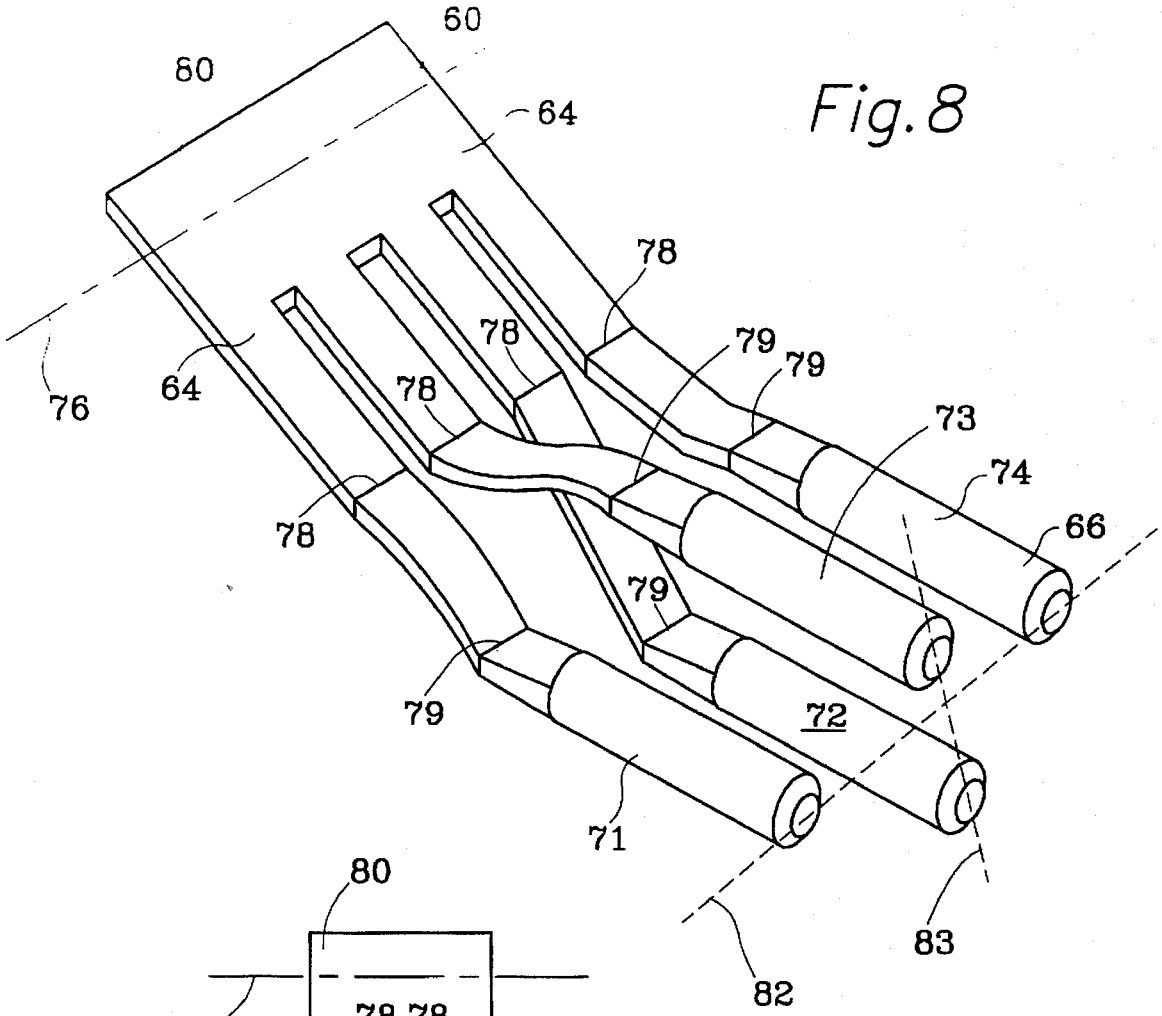
FIG. 8 is a perspective view of one group of fingers after the fingers are bent along defined bend lines.

FIG. 8 shows one group of fingers in perspective view. Each of the fingers is connected to the uncut portion 80 by its connective end 64. The distal end 66 of each finger extends away from the uncut portion 80. It can be seen that the distal ends 66 of the fingers are disposed with their tips in a common plane and arranged with the distal ends of the fingers 71 and 74 disposed in a common plane defined by line 82 while the other two fingers, 72 and 73, are arranged in a perpendicular plane represented by line 83. Alternatively stated, the tips of the four fingers are generally disposed at the corners of a quadrangular pattern and the four tips of the fingers are disposed in a common plane in which lines 82 and 84 are drawn. It should be understood that alternative configurations could dispose the tips of the fingers at the corners of alternative patterns. In FIG. 8, because of the perspective view, the first and second bend lines 78 are illustrated in a manner that makes them look generally parallel to axis 76. However, it should be clearly understood that a preferred embodiment of the present invention utilizes bend lines which are not parallel to axis 76 in order to permit the distal ends of the fingers to be selectively offset from their respective connective ends in a direction along axis 76. The apparent parallelism of the bend lines with axis 76 in FIG. 8 is due to the method of creating the perspective view and is not intended to imply that parallel bend lines are preferred.

With continued reference to FIG. 8, it should be noted that the distal ends 66 of the fingers are shown in a generally cylindrical cross sectional shape. Although all of the fingers begin as portions of generally flat strip stock, each of the distal ends 66 of the fingers can be formed into a cylindrical cross sectional shape in order to facilitate the use of the connector in many common applications. The provision of the cylindrical end of each finger can be achieved in several ways. Prior to, during or following the bending operation, the ends of the fingers can be swaged in order to deform the original flat shape into one that is generally cylindrical. Alternatively, the flat distal ends of the fingers can be rolled in order to create a generally tubular shape. Another possible technique that can be used to form the generally cylindrical cross sectional shape shown in FIG. 8 is to provide relatively thick strip stock and then shave the corners of the rectangular cross sections of the fingers to create an eight sided cross section that generally resembles a cylindrical pin and can be used in most common connector applications. Regardless of the specific technique used to provide the cylindrical end of the fingers, the cylindrical cross sectional shape of the distal ends 66 is advantageous in a most preferred embodiment of the present invention.

Figure 9:
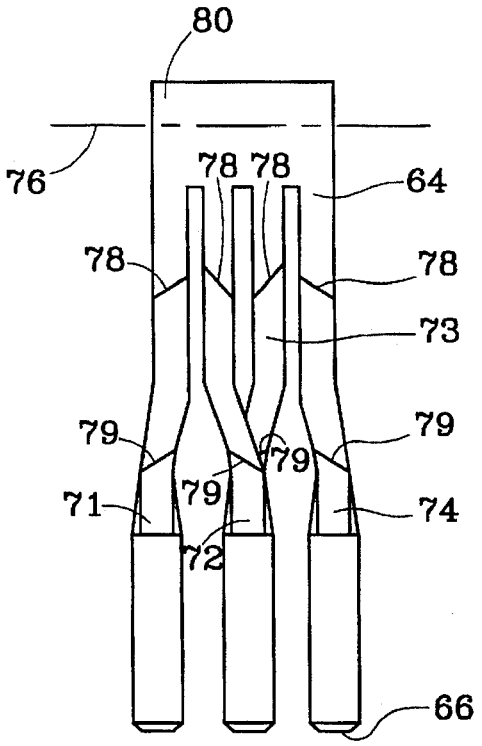
FIG. 9 is a top planar view of the illustration of FIG. 8.

FIG. 9 shows a top view of one group of fingers. Because of the significant angle between bend lines 78 and 79 of fingers 72 and 73, the distal ends of those two center fingers are offset significantly from their respective connective ends 64. In other words, in FIG. 9 the distal end 66 of finger 72 is offset toward the right relative to its connective end. Similarly, the distal end 66 of finger 73 is offset toward the left along axis 76 relative to the connective end 64 of finger 73. These two offsets place the distal ends 66 of the two center fingers in a vertical alignment as described above in conjunction with line 83 in FIG. 8. The two outer fingers, 71 and 74, are bent slightly compared to the more significant angle of the bend lines of fingers 72 and 73. This results in a slight offset from their respective connective ends 64 along axis 76.

In addition to creating the offset in the direction along axis 76, the bend lines also create an offset of the distal ends of the fingers relative to their connective ends in a direction perpendicular to the plane of the strip 60. This can be seen in FIG. 8. The combination of the offsets in the directions perpendicular to the strip and along the axis 76 creates the pattern of the distal ends which can be at the corners of a quadrangular pattern.

With reference to FIGS. 8 and 9, it should be noted that the connective ends 64 of the fingers remain in a common plane although their distal ends are significantly offset from the original common plane of the strip. All four of the distal ends are moved in directions that are parallel to the axis 76 and also perpendicular to the plane of the strip 60. During the cutting, defining, bending and forming operations that create the assembly shown in FIG. 8, all of the fingers remain connected to the uncut portion 80 of the strip 60. This allows the strip to be handled efficiently by automatic machinery and also significantly reduces the required handling of the components.

Figure 10A:
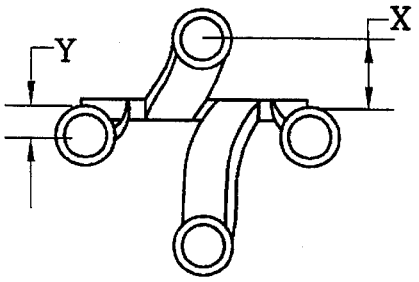
FIGS. 10A, 10B, 11A, 11B, 12A and 12B show two views of three possible bending arrangements of the fingers in accordance with the present invention.
Figure 10B:
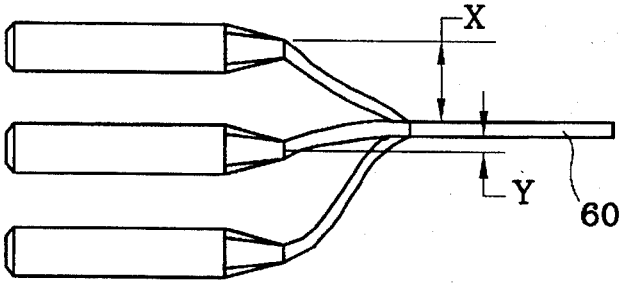

FIGS. 10A, 10B, 11A, 11B, 12A and 12B show various views of the fingers after being bent along bend lines of differing angles. In FIGS. 10A and 10B, the angles of the bend lines are chosen to offset the two central fingers by a dimension X in a direction perpendicular to the plane of the strip 60. The two outer fingers are offset by a slightly lesser magnitude Y. As can be seen in FIG. 10A, each of the distal ends of the fingers are also offset in a direction along axis 76 which is described above in conjunction with FIGS. 8 and 9.

Figure 11A:
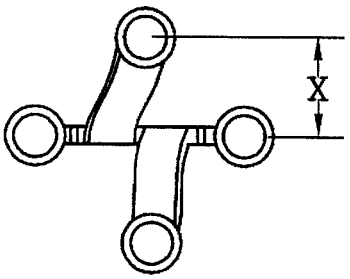
Figure 11B:
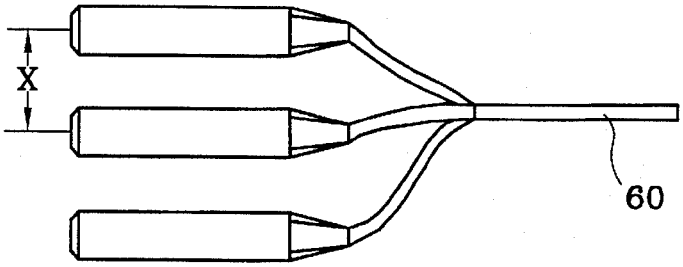

FIGS. 11A and lib show an application of the present invention which offsets the two central fingers by an amount that is greater than that shown in FIG. 10A. However, the bend lines used in conjunction with the outer fingers, 71 and 74, are generally parallel to axis 76 and, as a result, the distal ends of the outer fingers remain within the plane of the strip 60.

Figure 12A:
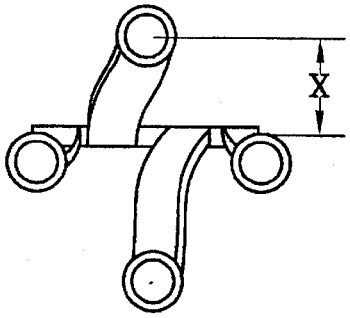
Figure 12B:
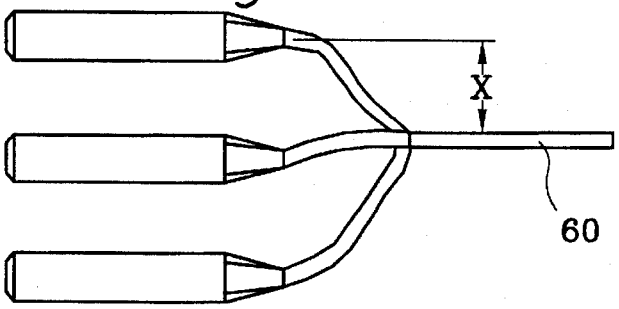

FIGS. 12A and 12B show the two central fingers being offset by an even greater amount from the plane of the strip 60 in combination with the two outer fingers being offset slightly from the plane of strip 60. As can be seen in the comparative examples of FIGS. 10A, 10B, 11A, 11B, 12A and 12B, the angles of the bend lines can be selected to displace the distal ends of the fingers to virtually any desired position relative to the plane of the strip 60. In each of the examples described above, the tips of the distal ends of the fingers are disposed at the corners of a pattern that could be a parallelogram, rectangle or square. In addition, asymmetrical patterns could be achieved through the basic principles described above.

Figure 13:
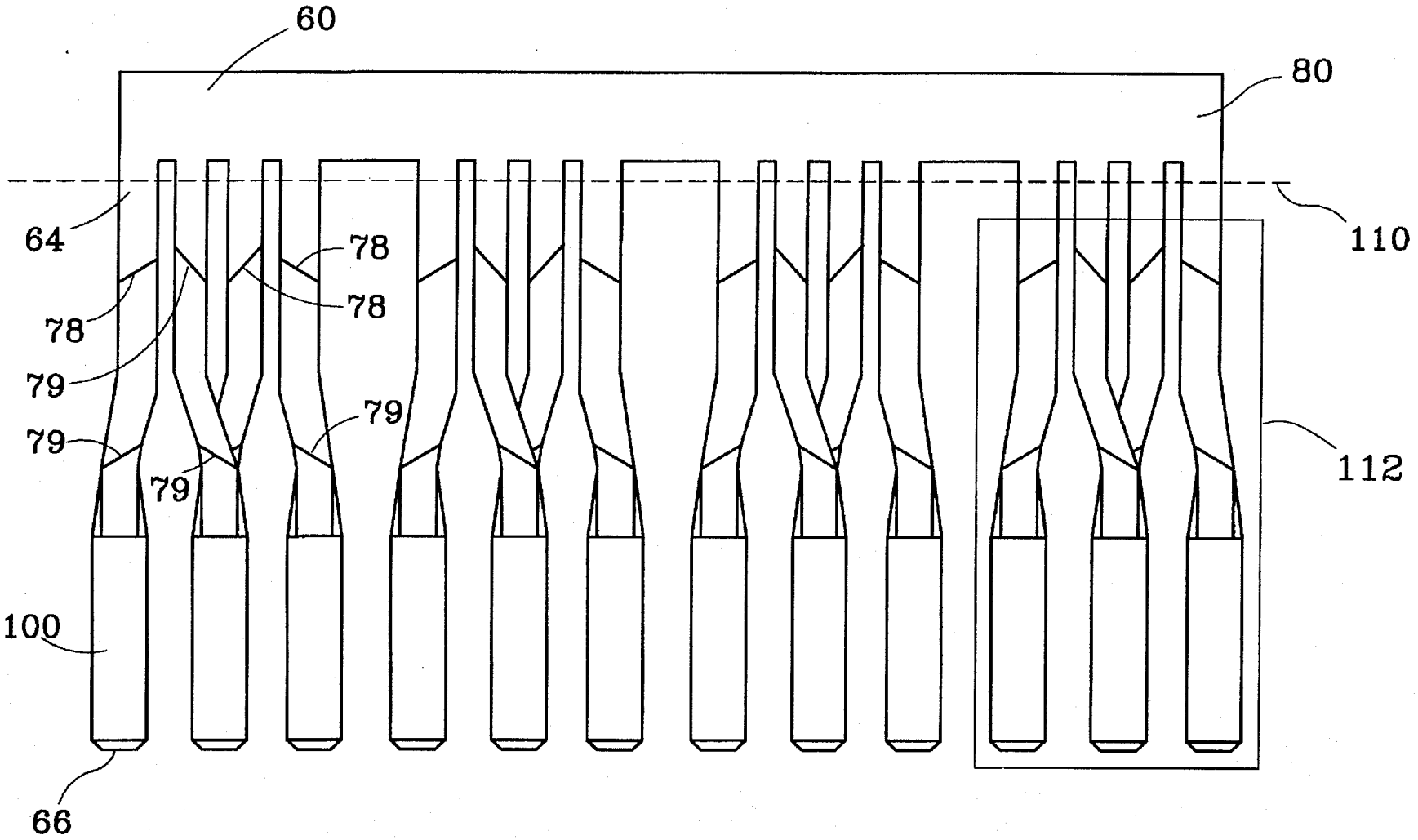
FIG. 13 shows a strip of conductive material with a plurality of groups of fingers bent according to the present invention.

FIG. 13 shows a strip 60 of conductive material with the plurality of groups of fingers extending from it in a direction perpendicular to its length. FIG. 13 also shows the fingers after they have been bent and their bend lines and formed to provide the generally cylindrical cross sectional shape at the distal ends 66. The cylindrical portion is identified by reference numeral 100 in FIG. 13. In FIG. 13, dashed line 110 shows where a cutting tool can be used to sever the individual groups of fingers from the uncut portion 80 of the strip 60. It should be understood that the groups of fingers would typically be severed at their connective ends 64 after they are molded within a structure of nonconductive material. Box 112 in FIG. 13 illustrates where the nonconductive material would be used to encompass the fingers after they are bent to form the associations illustrated in the Figures and described above. Although five groups of fingers are illustrated on the strip in FIG. 13, it should be understood that the strip 60 could be very long and could comprise hundreds of groups of fingers that are sequentially formed and shaped as the strip moves through a series of appropriately configured machine tools.

Figure 14:
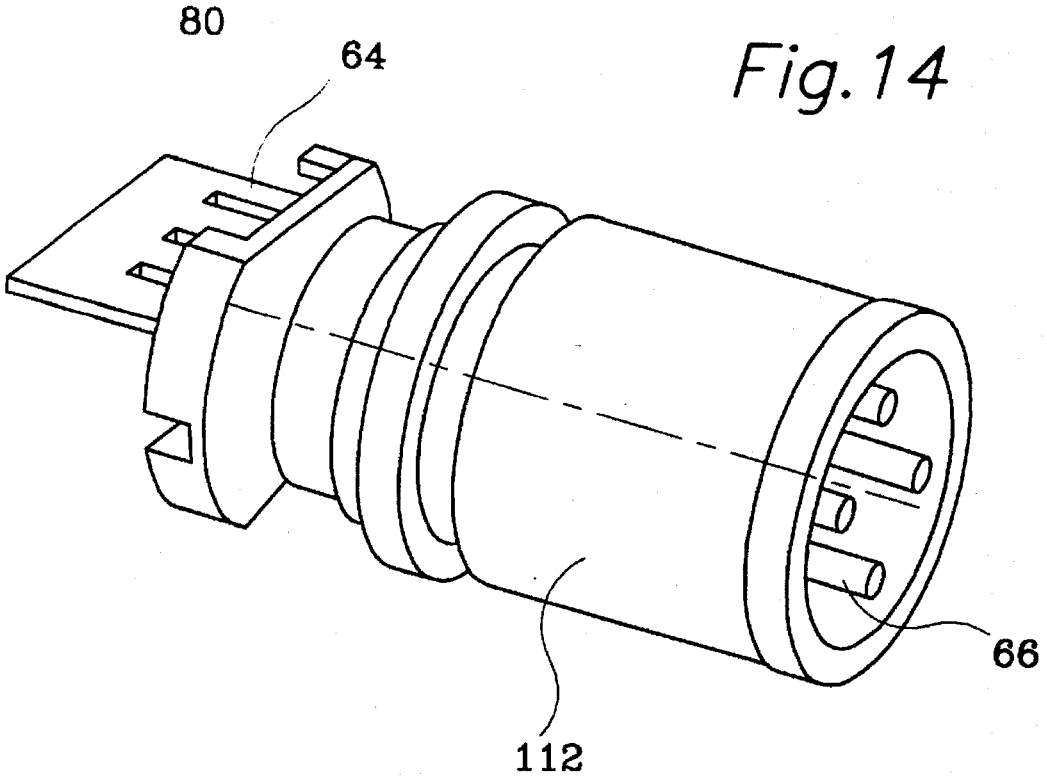
FIG. 14 shows an electrical connector with its distal ends extending from one end of the connector structure.

FIG. 14 shows a connector made in accordance with the principles of the present invention. The distal ends 66 extend in a first direction from the nonconductive material 112 that has been molded around the fingers. The connective ends 64 of the fingers extend in a direction generally opposite to that of the distal ends 66. The illustration in FIG. 14 shows the connective ends 64 prior to the operation which severs the uncut portion 80 from the connective ends 64. It should be understood that, although FIG. 14 shows a single connector severed from the strip but without the connective ends 64 severed from the uncut portion 80, a more typical application of the present invention would sever the connective ends 64 from the uncut portion 80 without cutting the strip 60 in a direction perpendicular to its length to singulate one connector from the strip. In other words, although for clarity the illustration in FIG. 14 shows a single completed connector with the uncut portion 80 still attached to the connective ends 64 of the fingers, this precise condition would be unlikely. Instead, the connective ends 64 of the fingers would typically be severed from the uncut portion 80 instead of the singulation operation that separates the connector from other connectors on the strip as shown in FIG. 14.

Figure 15:
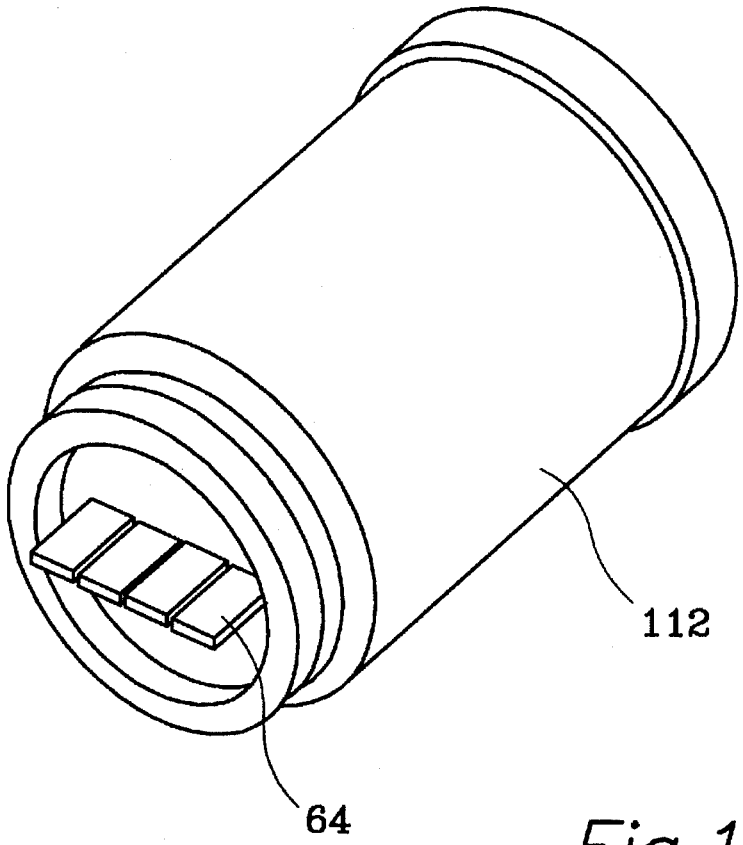
FIG. 15 shows an opposite end of the connector than FIG. 14 and with the connector severed from the strip of conductive material according to the principles of the present invention.

FIG. 15 shows the end of the connector where the connective ends 64 of the fingers have been severed from the uncut portion 80 of the conductive strip 60. As can be seen, the uncut ends 64 of the fingers are disposed in a common plane which is the same common plane in which the conductive strip 60 was disposed. The opposite end of the connector, on the other hand, disposes the distal ends 66 in a preselected pattern as shown in FIG. 14 and described above. A connector made in accordance with the present invention therefore provides a plurality of conductive fingers that extend through the connector and provide electrical connection between four preselected points at one end of the connector and four preselected points at the other end of the connector, wherein the points at opposite ends of the connector are arranged in different patterns. The four connective ends 64 are arranged in a plane that can easily be soldered to conductive runs on a common surface of a printed circuit board. The distal ends 66, on the other hand, are arranged in a diamond pattern that facilitates the connection of the connector to standard cable designs. The method of the present invention allows a connector of this type to be manufactured without the need for individually handling and machining electrically conductive pins and then maintaining the pins in accurate positions relative to each other during a subsequent molding procedure. In addition, the use of a continuous strip within the method of the present invention allows a significant of degree of automation to be implemented during the manufacture of the electrical connectors.

Although the present invention has described the manufacture of electrical connectors in significant detail and has illustrated various Figures with particular specificity, it should be understood that alternative embodiments of the present invention are also within its scope.

The embodiments of the invention in which an exclusive property or right is claimed are defined as follows:

1. A method for making an electrical connector, comprising:

providing a strip of electrically conductive material having a length and a width, said strip having a planar surface, a first axis extending along said length and a second axis extending along said width, said first and second axes being disposed within the plane of said strip and being generally perpendicular to each other, said strip having a plurality of electrically conductive fingers extending in a direction generally perpendicular to said length, each of said plurality of electrically conductive fingers having a connective end attached to said strip and a distal end extending away from said strip, a preselected one of said plurality of conductive fingers being shaped to offset its distal end from its connective end in a first direction along said first axis, said preselected one of said plurality of conductive fingers being shaped to offset said distal end in a direction which is generally perpendicular to said plane of said strip;

molding said plurality of electrically conductive fingers within an electrically nonconductive material with said distal ends protruding from said nonconductive material in a first direction and said connective ends protruding from said nonconductive material in a second direction, said first and second directions being generally parallel to each other; and severing said connective ends from said strip.

2. The method of claim 1, further comprising:

forming each of said distal ends into a generally cylindrical cross sectional shape.

3. The method of claim 1, wherein:

each of said distal ends is disposed at a different corner of a quadrangular pattern.

4. A method for making an electrical connector, comprising:

providing a strip of electrically conductive material having a length and a width, said strip having a planar surface and a plurality of electrically conductive fingers extending in a direction away from said strip, each of said plurality of electrically conductive fingers having a connective portion attached to said strip, a distal portion extending away from said strip and an intermediate portion connecting said connective portion to said distal portion, a preselected one of said plurality of electrically conductive fingers having said distal portion displaced from said connective portion in a direction generally parallel to said length and in a direction generally perpendicular to said planar surface of said strip;

molding said plurality of electrically conductive fingers within an electrically nonconductive material with said distal portions protruding from said nonconductive material in a first direction and said connective portions protruding from said nonconductive material in a second direction; and severing said connective ends from said strip.

5. The method of claim 4, further comprising:

forming each of said distal ends into a generally cylindrical cross sectional shape.

6. A method for making an electrical connector, comprising:

providing a generally flat strip of an electrically conductive material having a length and a width, said strip having a first axis extending along said length and a second axis extending along said width, said first and second axes being disposed within the plane of said strip and being generally perpendicular to each other;

forming a plurality of generally parallel cuts in said strip, each of said cuts extending partially through said width in a direction generally parallel to said second axis, said plurality of cuts defining a plurality of electrically conductive fingers extending perpendicular to said first axis, each of said plurality of electrically conductive fingers having a connective end attached to an uncut portion of said strip and a distal end extending away from said uncut portion;

defining first and second bend lines on each of said plurality of electrically conductive fingers, said first and second bend lines being in nonparallel relation to said first axis; and bending each of said plurality of electrically conductive fingers at each of said first and second bend lines to displace said distal end of each electrically conductive finger away from said connective end of the same electrically conductive finger in a direction parallel to said first axis and in a direction perpendicular to the plane of said strip.

7. The method of claim 6, further comprising:

forming each of said distal ends of said electrically conductive fingers into a generally cylindrical cross sectional shape.

8. The method of claim 6, further comprising:

molding an electrically nonconductive material over said plurality of electrically conductive fingers with said distal ends protruding from said nonconductive material in a first direction and with said connective ends protruding from said nonconductive material in a generally opposite direction.

9. The method of claim 6, further comprising:

severing said connective ends from said uncut portion.

10. The method of claim 6, wherein:

said plurality of distal ends is arranged in a quadrangular pattern with each of said distal ends being disposed at a different corner of said quadrangular pattern.

11. The method of claim 6, wherein:

said length is at least four times said width.

12. A connector made in accordance with the method of claim 6.

13. A connector, comprising:

a plurality of electrically conductive elements, each of said plurality of electrically conductive elements having a first end and a second end, said first ends of said plurality of electrically conductive elements extending in a common direction and being disposed at a preselected corner of a quadrangular pattern, said second ends of said plurality of electrically conductive elements being disposed in a common plane, each of said electrically conductive elements being electrically separated from the other electrically conductive elements; and an electrically insulative material disposed around said plurality of electrically conductive elements, said plurality of electrically conductive elements being rigidly attached to said electrically insulative material, each of said electrically conductive elements being bent at two bend lines to dispose its first end at a location which is offset from its second end in both a first direction and a second direction, said first direction being generally parallel to said common plane, said second direction being generally perpendicular to said common plane.

14. The connector of claim 13, wherein:

said electrically insulative material is plastic.

15. The method of claim 4, wherein:

said connective portion is generally parallel to said distal portion.

16. An electrical connector made by the method of claim 1.

* * * * *